US007896645B2

(12) United States Patent
Loving

(10) Patent No.: US 7,896,645 B2
(45) Date of Patent: Mar. 1, 2011

(54) THREE PHASED COMBUSTION SYSTEM

(75) Inventor: Ronald Everett Loving, Reno, NV (US)

(73) Assignee: Universal Cleanair Technologies, Reno, NV (US)

( * ) Notice: Subject to any disclaimer, the term of this patent is extended or adjusted under 35 U.S.C. 154(b) by 459 days.

(21) Appl. No.: 12/156,245

(22) Filed: May 30, 2008

(65) Prior Publication Data

US 2009/0320726 A1 Dec. 31, 2009

(51) Int. Cl.
*F23B 7/00* (2006.01)
*F23D 15/00* (2006.01)

(52) U.S. Cl. ..... 431/5; 431/351; 431/352; 431/353; 431/178; 110/210; 110/213; 110/265; 110/344; 110/260; 60/299; 60/274

(58) Field of Classification Search ..... 431/351, 431/352, 353, 5, 178; 110/210, 213, 214, 110/260, 265, 344, 365; 60/299, 274
See application file for complete search history.

(56) References Cited

U.S. PATENT DOCUMENTS 4,240,784 A * 12/1980 Dauvergne ..... 431/351
4,412,414 A * 11/1983 Novick et al. ..... 60/39.23
5,215,018 A * 6/1993 Sardari et al. ..... 110/235
5,320,523 A * 6/1994 Stark ..... 431/353
5,333,458 A * 8/1994 Loving ..... 60/722
5,337,567 A * 8/1994 Loving ..... 60/722
5,381,659 A * 1/1995 Loving et al. ..... 60/280
5,572,866 A * 11/1996 Loving ..... 60/274
7,047,893 B2 * 5/2006 Loving ..... 110/342
2006/0150614 A1 * 7/2006 Cummings ..... 60/275
2008/0041044 A1 * 2/2008 Tanaka ..... 60/301
2008/0047260 A1 * 2/2008 Kapsos et al. ..... 60/286
2008/0053073 A1 * 3/2008 Kalyanaraman et al. ..... 60/286
2008/0064587 A1 * 3/2008 Kanno et al. ..... 502/60
2008/0066456 A1 * 3/2008 Schmieg et al. ..... 60/286
2008/0072578 A1 * 3/2008 Kumar ..... 60/299
2008/0087008 A1 * 4/2008 Reba et al. ..... 60/301
2008/0087434 A1 * 4/2008 Wilen et al. ..... 166/312

OTHER PUBLICATIONS

NPL-STIC Search report.*

* cited by examiner

*Primary Examiner*—Carl D. Price
*Assistant Examiner*—Nikhil Mashruwala
(74) *Attorney, Agent, or Firm*—Knobe, Martens, Olson & Bear LLP

(57) ABSTRACT

A system when installed in-line with a pollution source provides reduction and/or complete combustion of harmful emissions generated there from. Such emissions including (but not limited to) compounds such as oxides of nitrogen, hydrocarbons, carbon monoxide, odors, organic and inorganic particulates. The pollution source can be of any type, such as smoke from a smokestack, engine exhaust, etc. The re-burner system is of very simple construction, is extremely energy efficient and does not require any moving parts or maintenance, respectively.

15 Claims, 8 Drawing Sheets

THREE PHASED COMBUSTION SYSTEM

FIELD OF THE INVENTION

This invention relates in general to new and improved devices used for reducing air pollution but more particularly pertains to a pollution re-burner system, respectively. The system when installed in-line with a pollution source provides reduction and/or complete combustion of harmful emissions generated there from. Such emissions including (but not limited to) compounds such as oxides of nitrogen, hydrocarbons, carbon monoxide, odors, organic and inorganic particulates. The pollution source can be of any type, such as smoke from a smokestack, engine exhaust, etc. The re-burner system is of very simple construction, is extremely energy efficient and does not require any moving parts or maintenance, respectively.

BACKGROUND OF THE INVENTION

This invention has been derived from building and testing numerous Thermal Oxidizer and heat reactors units since 1993. Originally conceived and tested to destroy automotive and diesel engine exhaust pollution it has now proven to be an excellent source of high temperature to destroy emissions exhausted through smoke stacks, restaurant exhaust vents and the like. The same basic design has now proven to be an energy efficient and economical way to eliminate pollutants from home and commercial heating applications as well.

Reducing air pollution, particularly emissions from heating devices and diesel engines, harmful fuel odors and particulates has become a strong environmental objective both in the United States and around the world. Because of worldwide tightening of pollution emission standards, inventors have continually tried to invent devices and methods that will meet these increasingly stringent standards. This invention is most efficient and is extremely simple in construction with no moving parts, is most advantageous and cost effective.

There have been numerous attempts within the known prior art to develop a device that would be feasible and efficient. However, heretofore true success has not been attainable. Some examples of the prior art include the following patents.

Publication Number: 2008/0041044, entitled, "Device for Purifying Exhaust Gas of an Internal Combustion Engine". This device is somewhat functional for its intended use but it is clearly very limited as it is specifically designed only for use with an internal combustion engine. It could not be used with any other type of pollution source. This is very unlike the present invention which is extremely versatile and applicable with any type of apparatus, engine, etc. More importantly the present invention greatly reduces NOx, soot, CO, hydrocarbons, VOC's and other pollutants as necessary in a new and novel manner.

Another example of known prior art is Publication Number: 2008/0047260, entitled "Exhaust After Treatment System With Spiral Mixer". This reference is again much too complicated and not feasible for numerous variable applications of use. The reference is somewhat functional if used with small engines but it is still very limited and uses numerous costly components, all of which the present invention completely eliminates.

A further example of known prior art is Publication Number: 2008/0053073, entitled "Reformer Assisted Lean NOx Catalyst After Treatment System And Method". This reference must be attached onto a lean burning, oxygen-rich engine only. For this device to operate it needs to be attached onto the engine and cannot be used with any type of exhaust system. More importantly the device requires use of expensive catalytic converters and various components, again all of which the present invention eliminates. If this device were to get even slightly fuel rich, the soot and hydrocarbons will clog-up the expensive catalytic converters, etc., thus, resulting in a device that is expensive, unreliable and simply not functional.

Another example of known prior art is Publication Number: 2008/0064587, entitled "Oxidation Catalyst For Exhaust Gas Purification, Catalyst Structure For Exhaust Gas Purification and Method for Purifying Exhaust Gas". This again is much too complicated and costly and additionally requires use of an oxidation catalyst. More importantly, this reference is only functional for removal of CO and HC and is not usable for reducing or eliminating pollution of any other type, such as NOx, $CO^2$ and Soot etc.

Still another example of known prior art includes Publication Number: 2008/0066456, entitled "Method and Apparatus To Selectively Reduce NOx In An Exhaust Gas Feedstream". Again this reference is extremely limited in use as it is only functional for reduction of NOx by the use of SCR and is only feasible for a four cycle engine. A two cycle engine only runs with a rich environment in the exhaust and would therefore overwhelm their catalysts. A further disadvantage of this reference is the requirement for silver in their catalyst of which further selectively reduces NOx. A four cycle engine running lean all the time is an engine without any power. The present invention is efficient with any type of exhaust and is clearly not limited to either a two or four cycle engine. The noted reference is still further limited as it injects inject HC into the system to work with a selective catalytic converter to reduce NOx. The present invention during normal operation injects fuel into the system to heat up the pollution in order to burn all constituents contained therein. Thus again when compared to the prior art the present invention is extremely simplified and eliminates the need for additional components/substances, etc., in a manner heretofore not taught.

Further prior art includes Publication Number: 2008/0072578, entitled "Treatment System and Methods For Internal Combustion Engine Exhaust Streams". This is a complex pollution management system where they have several catalysts in sequence in order to reduce the pollution. The reference uses noble metals and other precious metal components in the three way catalysts. Some of the noble metals in the platinum group exceed $2100.00 per ounce. This would become a very pricey set of catalytic converters, also in use HC and soot will clog the system eliminating any efficiency. The system requires extra air to provide for an engine lean burning exhaust atmosphere. Again the system is only adaptable for four cycle engines. The system is much too complex and expensive. The present invention accomplishes new and novel results without the need for expensive catalysts, precious metal components, etc.

Other prior art includes Publication Number: 2008/80087008, entitled "Duel Injector System For Diesel Emissions Control". Again this reference is simply not feasible due to the need for additional components, catalyst's, etc, all of which the present invention clearly eliminates. It is clear within the prior art the advantage of a "VORTEX" has not been recognized and incorporated such as taught within the present invention.

Still further prior art includes Publication Number: 2008/8008700, entitled "Exhaust Gas Purifying Apparatus For Engine". This reference is very complex and expensive to build. FIGS. 3 through 9 of the reference detail the complicated algorithms and or timing of the system. The complexity of the controller and its code are reflected in the complexity of the physical mechanical parts of the system.

Yet another type of prior art includes Publication Number: 2008/80087434, entitled "Engine/Steam Generator With Afterburner". This reference incorporates us of Hydrogen peroxide ($H_2O_2$), when mixed with hydrocarbon based liquids such as used in vehicles is also used as a strong oxidizing propellant in liquid propellant rocket motors. High concentrations of $H_2O_2$ will react violently with anything it comes in contact with. Notably, Iron and Copper are incompatible with hydrogen peroxide; both are common metals in all types of vehicles. It will also corrode the human skin in a very short time. Amongst other negatives with this system is that there are no infrastructures to handle this type of material near any roadways in the US or Europe, let alone the rest of the world. This is a very dangerous liquid to even think about putting into an automobile. High strength hydrogen peroxide 70% to 99% pure $H_2O_2$ is a volatile liquid that corrodes just about any metals or organic material that it comes in contact with.

There remains a continuous need for a device that can always eliminate virtually all compounds such as, hydrocarbons, carbon monoxide, odors and organic and inorganic particulates from pollution exhausted from a pollution source such as a household chimney, smokestack, or any type of exhaust vent and still be energy efficient and significantly reduce oxides of nitrogen and $CO_2$.

SUMMARY OF THE INVENTION

A primary object of the present invention is to provide a three phased combustion system that can use any type of liquid or gaseous fuel as a heat source. The conversion is generally 50% more efficient than current external combustion methods as the heat generated by the system consumes all hydrocarbons or anything with caloric value. The system is of simple construction requiring only a fuel/air/igniter/blower injection apparatus, a pollution delivery structure and an elongated cylinder.

It is therefore an object of the present invention to provide a three phased combustion system that overcomes the drawbacks and disadvantages associated within the known prior art. For example, the present invention has been simplified and accomplishes unusual results heretofore not achieved. The new end results are mainly attributable to the novel construction of pollution delivery structure and the elongated cylinder in combination.

Yet another important object of the present invention is to provide an improved highly efficient fuel/air/igniter/blower injection apparatus of which is functional with either a gaseous substance or a liquid substance. Due to the construction of the fuel/air/igniter/blower injection apparatus and associated adapter, reduction of carbon/soot buildup is substantially eliminated.

Still another object of the present invention is to provide enhanced performance due to the injection of urea into the reaction chamber via a novel urea delivery structure. However, it is to be noted in the event that the urea tank were to be emptied, the system would still provide "fuel staging" and 50% reduction of NOx unlike any other urea prior art systems.

Another object of the present invention is to provide a three phased combustion system that requires little or no maintenance, as it is extremely efficient and durable.

Still another object of the present invention is to provide a three phased combustion that can be easily manufactured, is extremely cost effective, very efficient and marketable.

Other objects and advantages will be seen when taken into consideration with the following specification and drawings.

DETAILED DESCRIPTION OF THE DRAWINGS

Referring now in detail to the drawings wherein like characters refer to like elements throughout the various views. The present invention is substantially a three phased combustion system (10) that is extremely functional for reduction of harmful pollutants generated from a pollution source. It is to be noted the system is efficient for numerous types of pollution including emissions from smokestacks, any engine exhaust, restaurant flumes, etc. Thus the invention is not to be limited to any specific type of pollution.

Figure 1:
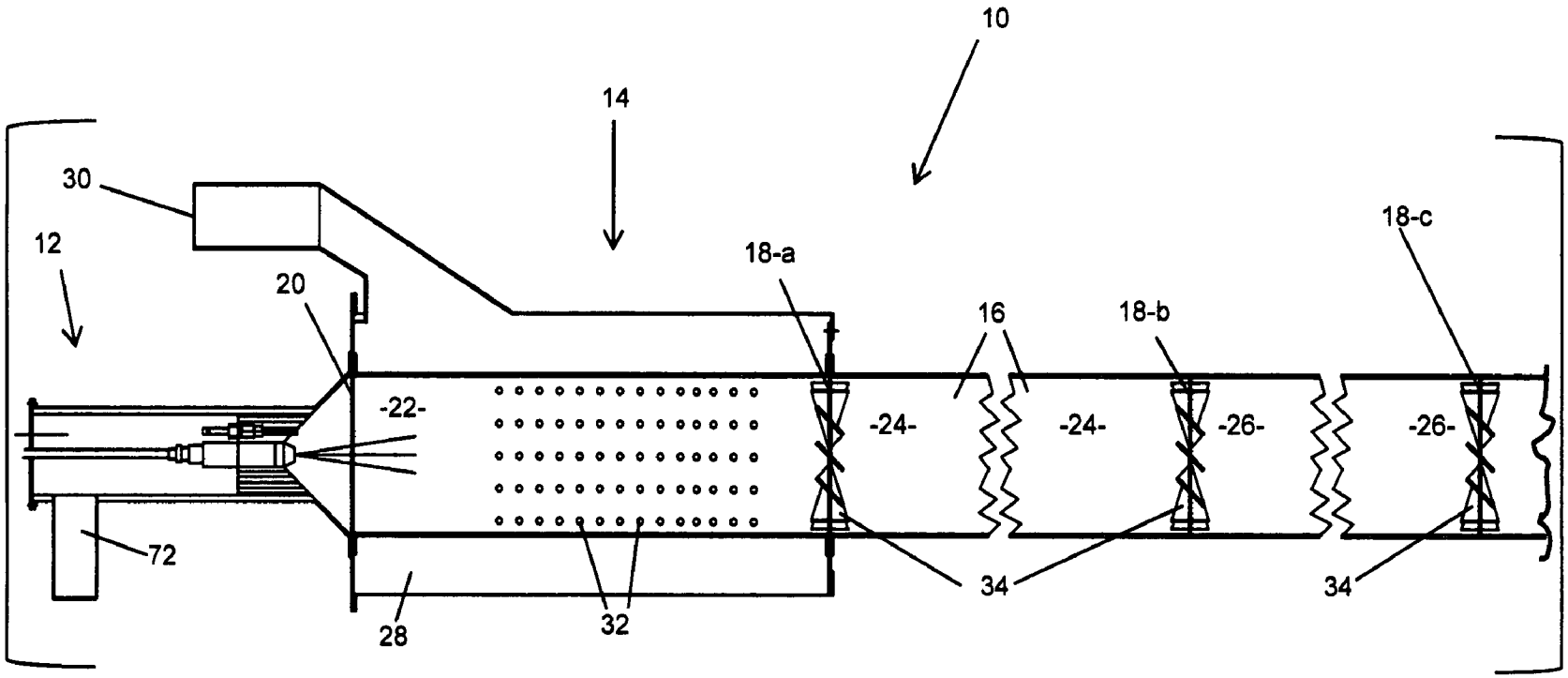
FIG. 1 is substantially an overall plan view depicting the preferred embodiment for the present invention.

The overall construction and functional parameters of the invention are exceptionally simple and basically requires only three components, namely, a fuel/air/igniter/blower injection apparatus (12), a pollution delivery structure (14) and an elongated cylinder (16). As depicted in FIG. 1, the elongated cylinder (16) is internally partitioned by a first baffle plate (18-*a*), a second baffle plate (18-*b*) and a third baffle plate (18-*c*). The elongated cylinder (16) includes a fuel/air inlet end (20) which in combination with the first baffle plate (18-*a*) define a first phase first phase mixing chamber (22) there between. As further illustrated, the first baffle plate (18-*a*) with the second baffle plate (18-*b*) in combination define a second phase combustion chamber (24) there between and the second baffle plate (18-*b*) with the third baffle plate (18-*c*) define a third phase reaction chamber (26) there between. It is to be understood that the third baffle plate (18-*c*) also provides an exit means (later described) for expelling resultant hot environmentally friendly air there from.

As further illustrated in FIG. 1, the first phase first phase mixing chamber (22) provides a first outer radius and the pollution delivery structure (14) is of a length equal to the first phase mixing chamber (22). The pollution delivery structure (14) provides a second outer radius that is larger than the first outer radius. Thus the first phase mixing chamber (22) is contained within the pollution delivery structure (14) yet spaced apart forming a circulating pollution flow passage (28) there between externally around the first phase mixing chamber (22). The pollution delivery structure (14) further includes a pollution inlet duct (30) for receiving forcibly directed pollution therein. The pollution inlet duct (30) is in open communication with the pollution flow passage (28) for delivering forcibly directed pollution thereto and the first phase mixing chamber (22) has pollution inlet apertures (32) there through for delivering the forcibly directed pollution into the first phase mixing chamber (22). It is to be noted that for the system to function more efficiently, the optimal construction for each of the inlet apertures (32) is substantially at 45°, this further increases the spiraling motion within the mixing chamber (22) and increases both velocity and strength of the first internal vortex there within.

It can now be seen that during operation, when the fuel/air mixture with the pollution is forcibly directed into the first phase mixing chamber (22) and then ignited, the fuel/air mixture with the pollution in combination, are chemically converted into a first phase gaseous substance. Thereafter, due to the construction of the first phase mixing chamber (22) with the fuel/air/igniter/blower injection apparatus (12) and the first baffle plate (18-*a*) in combination, a first internal vortex (consisting of a first phase gaseous substance) is created within the first phase first phase mixing chamber (22). Therefore, the first phase results in increased dwell time wherein all particulate matter is forcibly concentrated toward and into the eye of the first internal vortex. Furthermore, this simultaneously causes NOx within the first phase gaseous substance to be converted into a nitrogen/oxygen mixture. To finalize the first phase the first baffle plate (18-*a*) has multiple directional vanes (34) for receiving and delivering the nitrogen/oxygen mixture into the second phase combustion chamber (24) for continuing the process as follows.

The second phase begins when the nitrogen/oxygen mixture is forcibly directed into the second phase combustion chamber (24). Due to the construction of the first baffle plate (18-*a*) with the second phase combustion chamber (24) and the second baffle plate (18-*b*) in combination, a second internal vortex (consisting of predominantly nitrogen) is created within the second phase combustion chamber (24). This further provides increased dwell time of which in turn produces intense heat of which results in consumption of the majority of any remaining oxygen. Thus, resulting in an "oxygen deprived nitrogen mixture" and almost total destruction of NOx because the "oxygen deprived nitrogen mixture" has minimal oxygen atoms to bond with. To finalize the second phase the second baffle plate (18-*b*) also has directional vanes (34) for receiving and delivering the now oxygen deprived nitrogen mixture into the third phase reaction chamber (26) for continuing the process as follows.

The third phase begins when the oxygen deprived nitrogen mixture is forcibly directed into the third phase reaction chamber (26). Due to the construction of the second baffle plate (18-*b*) with the third phase reaction chamber (26) and the third baffle plate in combination, a third internal vortex is created within the third phase reaction chamber (26) (consisting of predominantly nitrogen, $CO_2$ and CO), this simultaneously resulting in a dramatic decrease of said intense heat resulting in a lower temperature wherein NOx cannot formulate. Thus within the third phase reaction chamber the process is finalized and the resultant hot environmentally friendly air can be expelled there from (via any appropriate exit means) and the resultant hot environmentally friendly air is usable for energy purposes.

Figure 2:
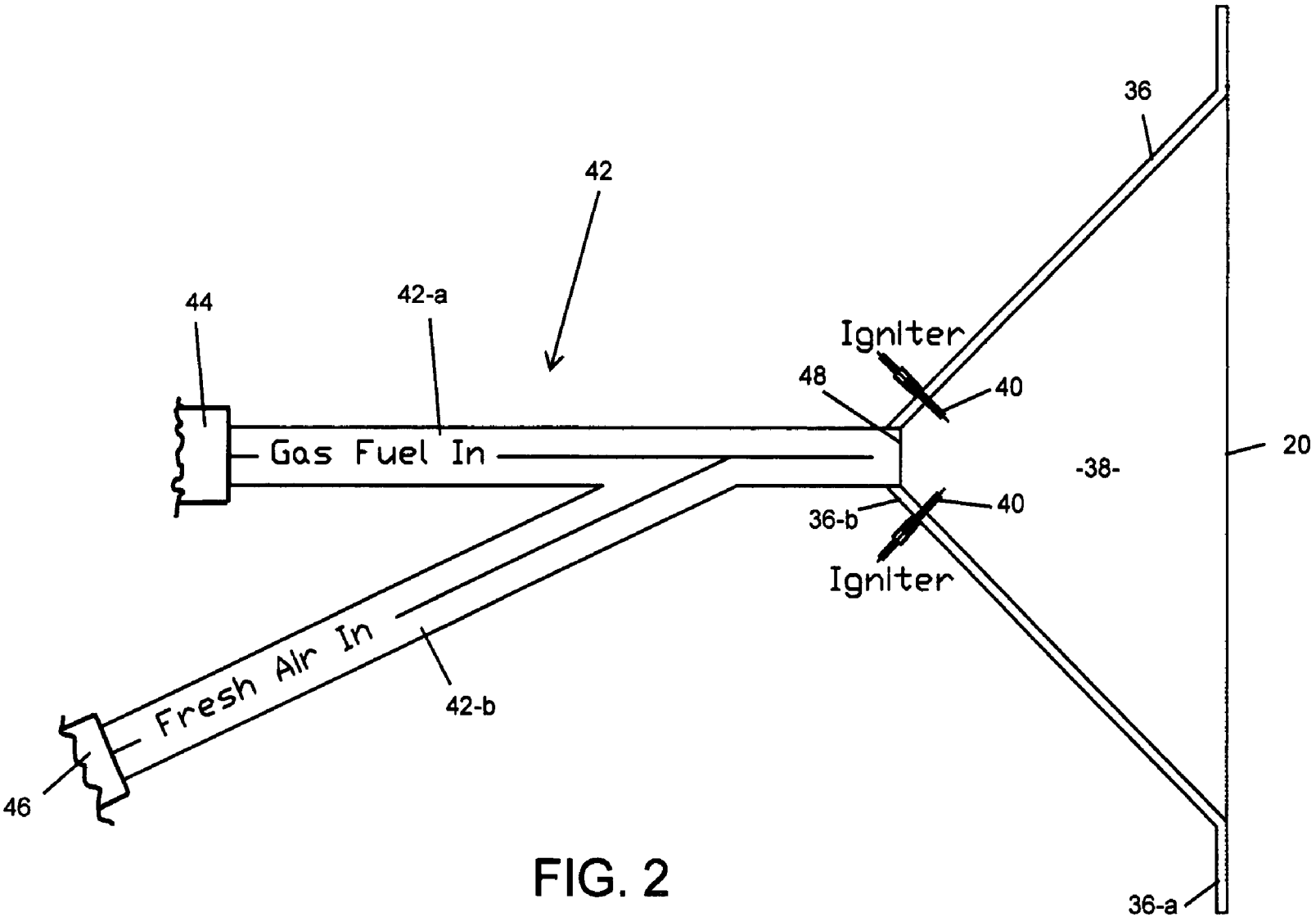
FIG. 2 is substantially an overall plan view for a gaseous fuel/air/igniter/blower injection apparatus.

Referring now in detail to FIG. 2, wherein illustrated is a first embodiment for the fuel/air/igniter/blower injection apparatus (12). As depicted the fuel/air/igniter/blower injection apparatus (12) includes an adapter assembly (36) having an enlarged first open end (36-*a*), an opposite smaller open end (36-*b*), an internal ignition zone (38) and igniter(s) (40). It is to be noted one or multiple igniters are optional depending on engineering choice and/or variable applications of use. The enlarged first open end (36-*a*) is of a shape and size to mate with the fuel/air inlet (20) of the elongated cylinder (16) and is fixedly attached thereon by any suitable attachment means of choice, such as by welding or the like. The opposite smaller open end (36-*b*) is attached onto a pipe fixture (42) having a first extension (42-*a*) and a second extension (42-*b*). The first extension (42-*a*) is in open communication with a gaseous fuel delivery port (44). It is to be noted any suitable type of gaseous fuel may be injected, depending on the application at hand and engineering choice. Examples of some optional gaseous fuels include but are not limited to propane, natural gas, methane, butane etc. The second extension (42-*b*) is in open communication with a fresh air delivery port (46). The gaseous fuel delivery port (44) and the fresh air delivery port (46) are in open communication via the pipe fixture (42) resulting in production of the fuel/air mixture. The pipe fixture (42) has an open exit port (48) that is in alignment with the internal ignition zone (38) for delivery of the fuel/air mixture from the open exit port (48) into the internal ignition zone (38) and the opposing pair of igniter(s) (40) being mounted onto the adapter assembly (36) in open communication with the ignition zone (38) for igniting the fuel/air mixture within the ignition zone (38).

Figure 3:
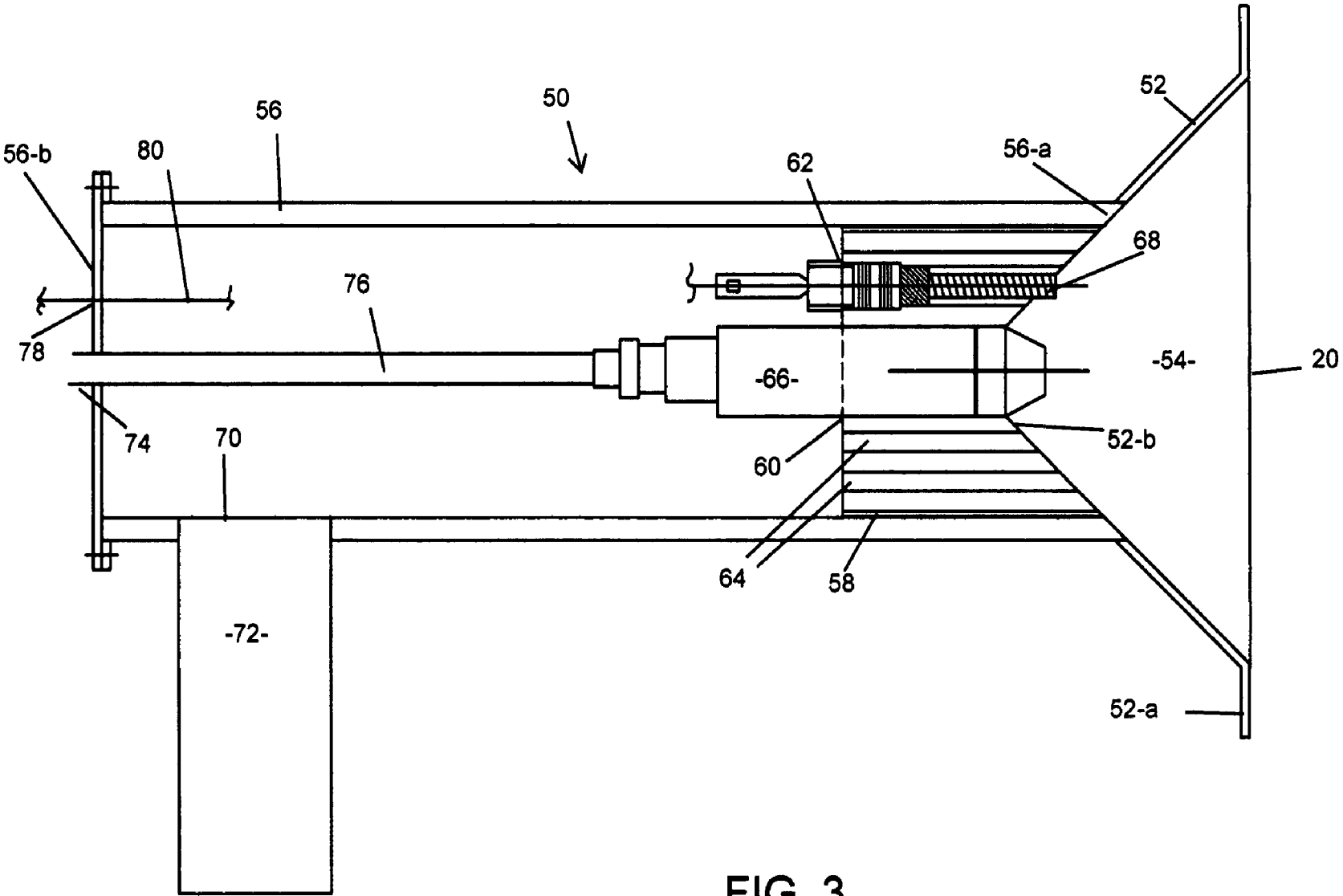
FIG. 3 is substantially an overall plan view for a liquid fuel/air/igniter/blower injection apparatus.

Referring now to FIG. 3 wherein illustrated is a second embodiment for the fuel/air/igniter/blower injection apparatus (50). As depicted the fuel/air/igniter/blower injection apparatus (50) includes an adapter assembly (52) having an enlarged first open end (52-*a*), an opposite smaller open end (52-*b*), an internal ignition zone (54), an elongated tubular member (56) and a fuel nozzle/igniter support structure (58). The enlarged first open end (52-*a*) is of a shape and size to mate with the fuel/air inlet (20) of the elongated cylinder (16). The elongated tubular member (56) has a first end (56-*a*) that is externally mounted onto the adapter assembly (52) and an enclosed second end (56-*b*). The elongated tubular member (56) houses the fuel nozzle/igniter support structure (58) therein. The fuel nozzle/igniter support structure (58) has a first aperture (60), a second aperture (62) and multiple air apertures (64) there through. The first aperture (60) being of a shape and size to receive and fixedly support a fuel nozzle (66) therein and the second aperture (62) being of a size to receive and fixedly support an igniter (68) therein. The first aperture (60) with the fuel nozzle (68) being in open communication with the ignition zone (54). The second aperture (62) with the igniter (68) being in open communication with the ignition zone (54). The elongated tubular member (56) has a fresh air inlet duct (70) for receiving and delivering fresh air into the elongated tubular member (56) via a blower (72). The multiple air apertures (64) are in open communication with the ignition zone (54) for delivering fresh air from the blower (72) into the ignition zone (54). The enclosed second end (56-*b*) has a fuel line receptacle (74) there through for support of a fuel line (76) therein. The fuel line (76) is interconnected onto the fuel nozzle (66) for supplying fuel into the ignition zone (54) via the fuel nozzle (66). The enclosed second end (56-*b*) has an opening (78) there through for containment of an electrical lead (80) and the electrical lead (80) is interconnected onto the igniter (66) for energizing thereof. It is to be noted any suitable type of liquid fuel may be injected, depending on the application at hand and engineering choice. Examples of some optional liquid fuels include but are not limited to gasoline, aviation fuel, oil, kerosene, alcohol, vegetable oil, etc.

It is to be understood that the present invention is functional with any type of fuel/air/igniter/blower injection apparatus of engineering choice. However, the applicant has found that the actual shape of the adapter assembly (either 36 or 52) is of great importance. Extensive experiments have proven that the entire system is much more efficient and functional if the adapter is of a shape having only smooth internal surfaces. Thus, the shape of the adapter can be a convex, curve, bow, bowl, funnel, cone, round or U-shaped, etc., each of which provide varying characteristics and enhance performance. The most important aspect of the adapter construction is that there are no internal sharp angles or broken areas where eddy currents or vortices (Vortex) can form. If there are any sharp angles or areas where the gases slow down or form a dead space within the adapter, carbon/soot will start to form and in a short amount of time a build up will cause other numerous problems to occur. As a result due to the novel shape of the adapter, the present invention resolves important malfunction issues associated with the prior art. Thus, the present invention provides new and unexpected results heretofore not taught or known.

Another very important advantage of the present invention is the novel arrangement for the fuel/air/igniter/blower injection apparatus. The present invention is suitable for use with either a gaseous substance or a liquid substance.

In reference to FIG. 2, the preferred embodiment for the gaseous fuel/air/igniter/blower injection apparatus is depicted, wherein new and unusual results are achieved because of the novel construction of the pipe fixture (42), the angle of the incoming gas/air extensions (42-*a*) and (42-*b*) and the angle of the igniter(s) (40) in combination. Through much experimentation it was discovered for optimal performance the angle of the pipe fixture extensions and igniter(s) is extremely important. Thus, the angle for the extensions is preferably between 25° and 45°. The angle of the two can be less than the 25° but anything greater than 45° causes a slowdown in the delivery of the gaseous fuel because the fuel is not forced along as fast as the incoming air from the radial outflow air blower. Therefore, the embodiment as depicted in FIG. 2 is optimal for a gaseous substance. Again any suitable type of liquid substance of engineering choice is applicable, such as but not limited to gasoline, aviation fuel, oil, kerosene, vegetable oil or alcohol.

In reference to FIG. 3, the preferred embodiment for a liquid fuel/air/igniter/blower injection apparatus is depicted, wherein new and unusual results are achieved because of the novel construction of the elongated tubular member (56) and the fuel nozzle/igniter support structure (58) in combination.

Figure 4:
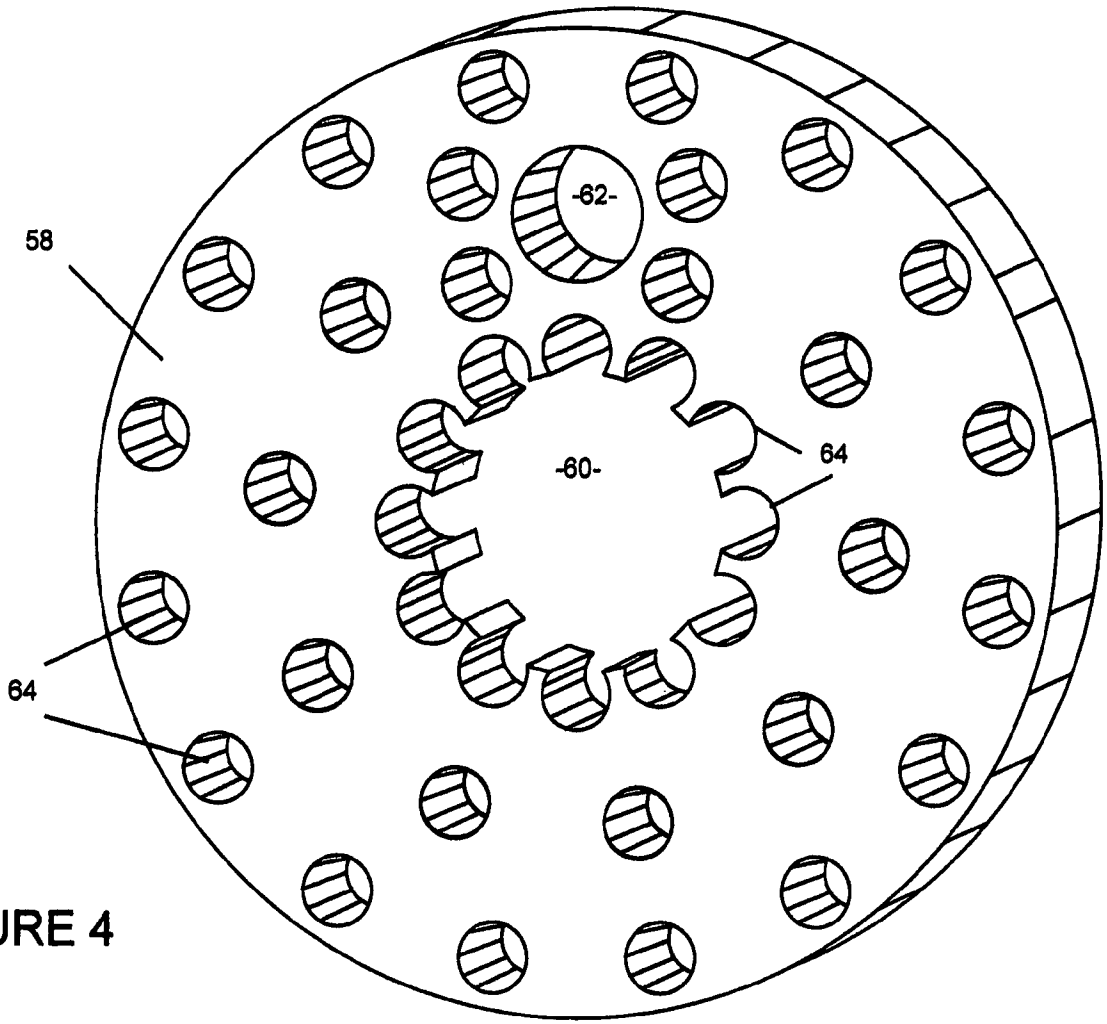
FIG. 4 is substantially a perspective end view depicting a fuel/nozzle support structure.

To further define the fuel nozzle/igniter support structure (58) I now refer to FIG. 4 which illustrates a perspective end view of the fuel nozzle/igniter support structure (58). As clearly depicted the fuel nozzle/igniter support structure (58) includes multiple air apertures (64) that run longitudinally there through. This proves to be most beneficial as this keeps the fuel nozzle (66) and the fuel nozzle/igniter support structure (58) cool. Also, this is important because if the temperature is too hot, above 600 degrees F., the fuel in the lines begin to transform into carbon and this clogs the fuel lines, nozzle, etc., this condition is referred to as "coaking". This embodiment is further advantageous because the multiple air apertures (64) that direct the pressurized air, distribute the air flow so as to eliminate any eddy currents or vortices from forming in the ignition zone 54. Without this unified distribution of pressurized air, there would be lots of soot and "coaking" in the ignition zone (54). Furthermore, being the nozzle (66) is centrally located and the igniter (68) is slightly off-center this provides excellent fuel/air/mixing/ignition and optimal performance. Still further it is to be noted the smaller the nozzle and the igniter are "the better" as this reduces back pressure/flow from entering the fresh air intake. Therefore, this embodiment is novel as it is constructed to keep the fuel nozzle/igniter support structure (58) and the adapter clean which in turn greatly enhances performance.

Figure 5:
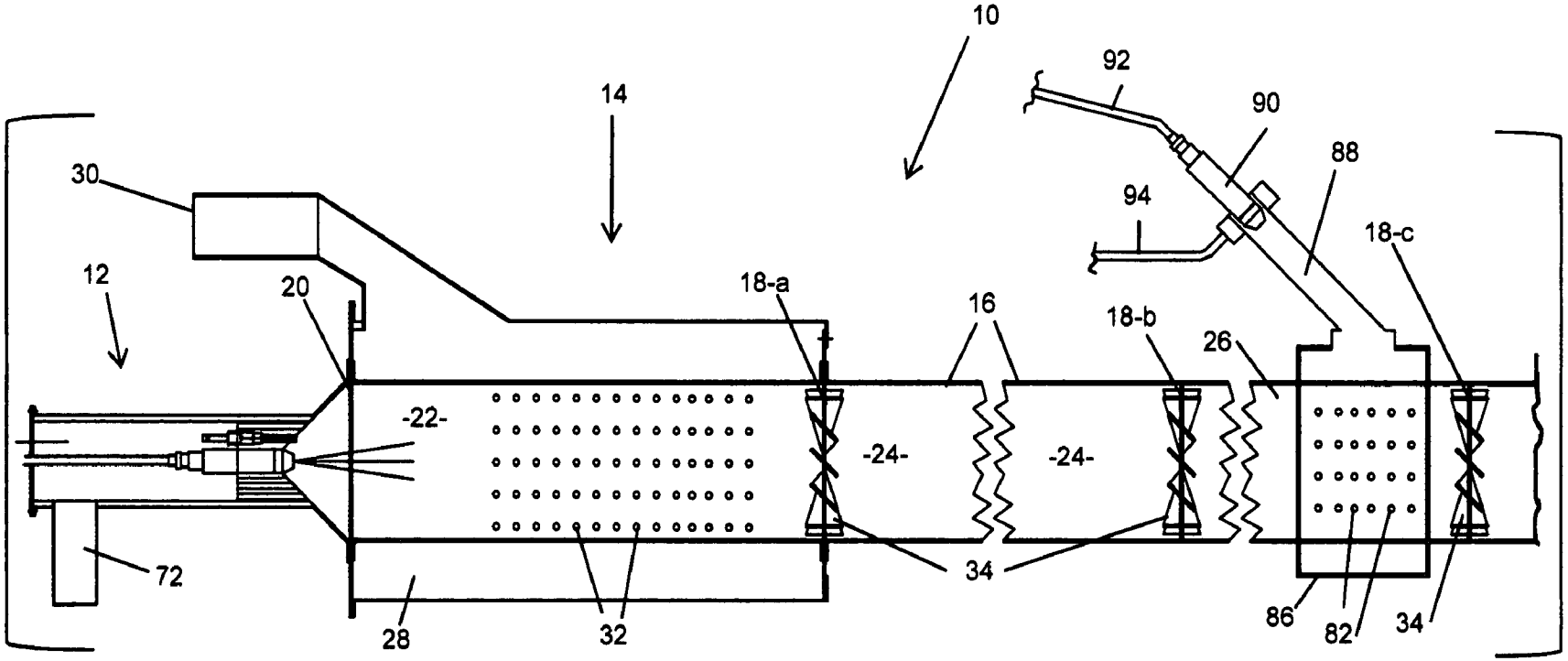
FIG. 5 is substantially an overall plan view depicting a second embodiment for the present invention including a urea delivery structure.
Figure 6:
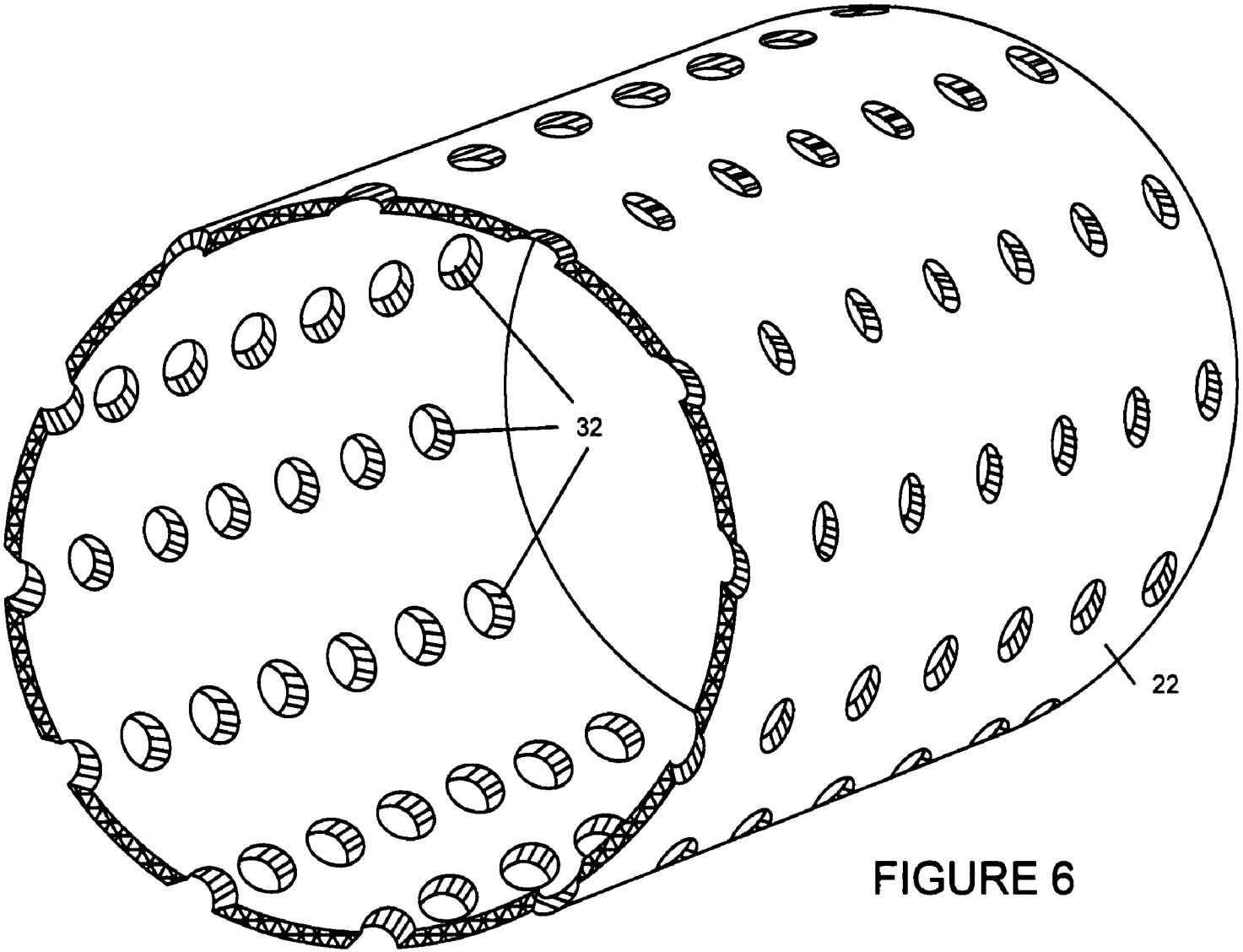
FIG. 6 is substantially a perspective sectional view depicting the preferred construction of the mixing chamber located within the pollution delivery structure.

It is to be noted the embodiment as depicted in FIG. 1 is functional in itself. However, exceptional enhanced performance is further achieved by the embodiment depicted in FIG. 5. Wherein, the reaction chamber (26) further includes inlet holes (82) for receiving a urea substance there through via a urea delivery structure (84). The urea delivery structure (84) is constructed from a canister (86) having an internal radius that is larger than the first outer radius (previously noted). The canister (86) has a left side end and a right side end, each of which are fixedly attached onto an external surface surrounding the reaction chamber (26) so as to encase the area with inlet holes (82). Thus the canister (86) forms an internal air pocket surrounding the area of the reaction chamber (26) and the inlet holes (82) and the air pocket is in open communication with the inlet holes. The canister (86) is interconnected onto a urea substance delivery conduit (88) and the urea substance delivery conduit is interconnected onto a urea injection nozzle (90) and a urea fill tube (92) for receiving the urea substance there through from within the urea metering pump. The urea substance delivery conduit (88) is interconnected onto a urea air blower via a urea air hose (94). The urea substance delivery conduit (88) is in open communication with the air pocket and the inlet holes (82) for supplying the urea substance to the reaction chamber. Whereby, as a result when the urea substance of which is considered a chemical compound $NH_3$ is injected into the reaction chamber (26) it greatly reduces any remaining NOx, referred to "Selective Non-Catalytic Reduction" or "SNCR". This reduction process has the potential to reduce NOx by as much as 90 percent. Furthermore, the Urea in the pollution exhaust stream can catalyze NOx back to nitrogen and water. Therefore, the urea further enhances the overall performance and efficiency of the present invention.

Figure 8:
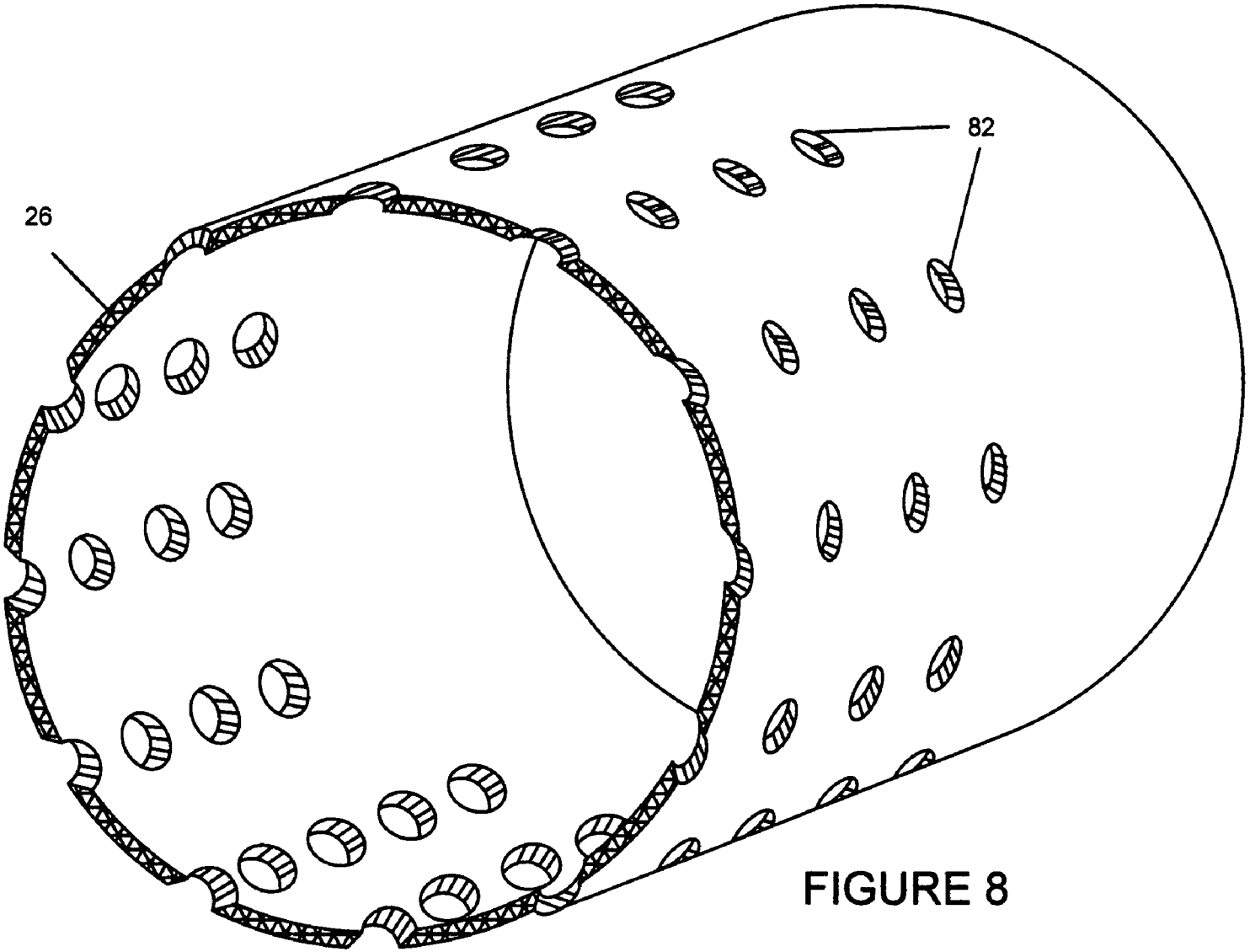
FIG. 8 is substantially a perspective sectional end view depicting the preferred construction of the reaction chamber associated with the urea delivery structure.

In reference to FIG. 8, it is to be noted for further enhanced performance the inlet holes (82) of the reaction chamber are preferably angled at 45° to the lateral, in a counter clockwise direction. Due to the angle this further increases the spiraling motion within the reaction chamber (26) and increases the velocity and strength of the third internal vortex. However, numerous holes and various arrangements thereof are inherent and the invention is not to be limited to any specific amount or configuration of holes.

It is to be understood that the present pollution re-burner system is functional with any standard components, electronics and/or programs associated within the field. For example, standard operational systems of this type generally include a controller/computer, fuel pump/tank, air blower, fuel/igniter/injection assembly, thermocouples, meters etc. Therefore, the present invention is not to be limited to any particular prior art operational standards as such are numerous and inherently variable. However, the present invention does include new and novel features of which incorporate use of the above noted urea delivery structure (84) and advanced operational parameters associated therewith. To more clearly define these new and advanced specifics, I now refer to FIG. 7.

Figure 7:
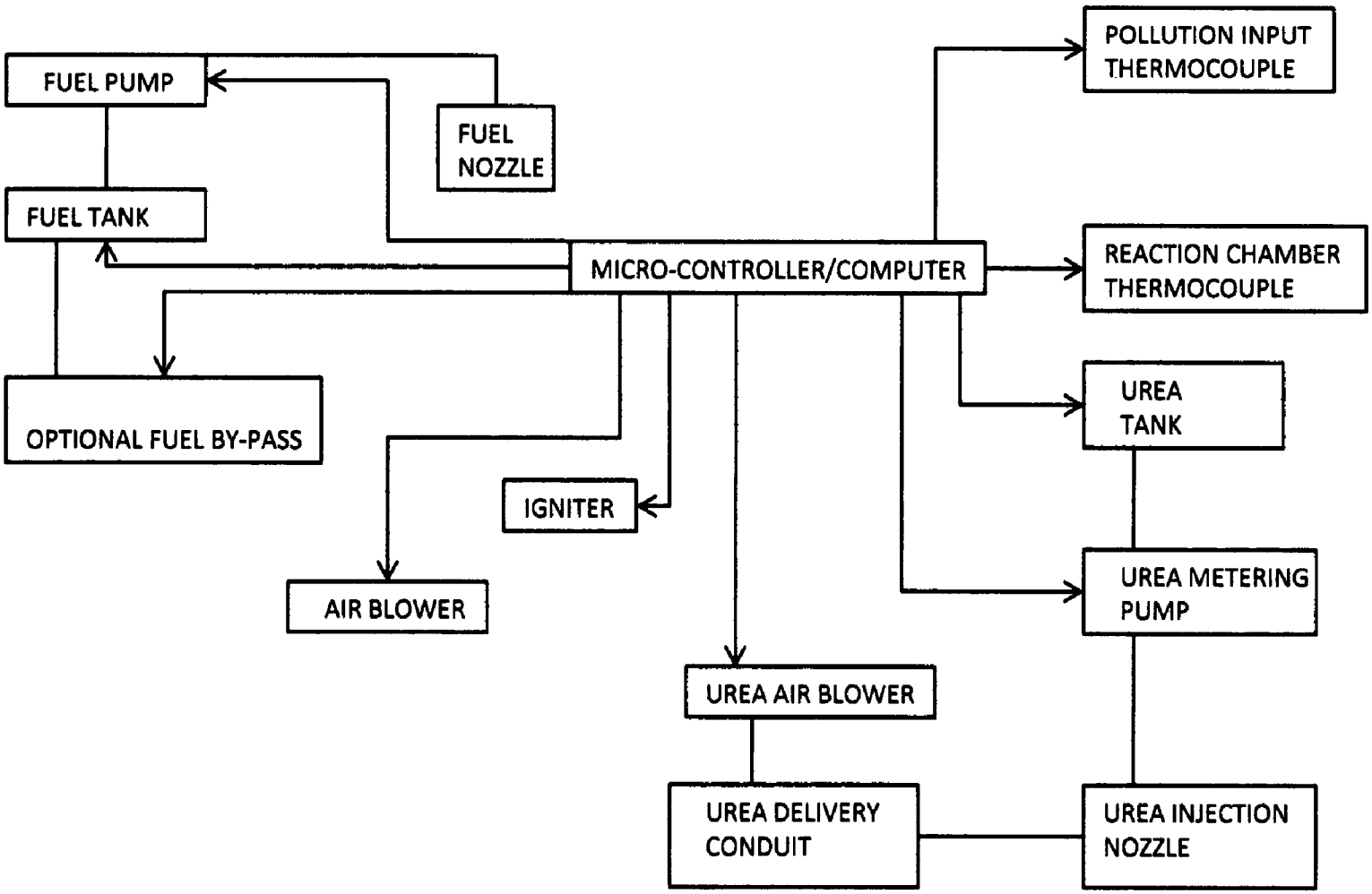
FIG. 7 is substantially a schematic overview of the operational parameters and components associated with the entire system.

FIG. 7 illustrates the preferred embodiment and/or schematic for overall enhanced performance for the present invention. Wherein as depicted, the three phased combustion system further includes a controller/microcomputer that allows and provides adjustable/variable alternatives for control and programming of the entire system. Thus, the novel system is adaptable for many different uses and/or applications of engineering choice and/or end user preferences.

The controller/microcomputer is interconnected (via standard electrical leads) in electrical communication with a fuel pump, a fuel tank, an air blower, an igniter(s), an optional fuel by-pass, urea air blower, a pollution input thermocouple, a reaction chamber thermocouple, a urea metering pump and a urea tank. It is to be noted the fuel by-pass is "optional" but is functional for returning any excess fuel back to the fuel tank for re-use for economical advantage. As illustrated within FIG. 7, the micro-controller/computer is in electrical communication with the above noted components as defined by "arrows". The following components are interconnected in communication with each other as defined by "lines". Namely, the fuel pump, the fuel tank, fuel nozzle are interconnected. The urea air blower, the urea substance delivery conduit, urea injection nozzle, urea metering pump and the urea tank are interconnected. All of which are illustrated within FIG. 7.

In actual operation, the following procedural steps more clearly define proper operating parameters for programming the system.

Micro-Controller/Computer Program Sequence

1. Turn system on/off switch to the on position.
   System controller is now powered up.
2. System Start up sequence is started.
   a. System takes readings from the two thermocouples.
   b. Igniter is powered up.
   c. 20 sec delay while the igniter comes up to temperature
   d. Fuel pressure is brought up.
   e. Fuel is sprayed into the Mixing Chamber and ignited.
   f. As the fuel is ignited, air is blown into the Mixing Chamber.
   g. The burning air and fuel mixture pass into the Combustion Chamber for total combustion of the fuel.
   h. After combustion the remaining gases pass on into the Reaction Chamber.
   i. The thermocouple in the Mixing Chamber monitors the exhaust gas temperature for the controller.
   j. When the correct temperature is reached the pollution exhaust will be allowed in through the input tube to the reaction chamber.
   k. When the right temperature is reached Urea liquid will be sprayed into the Reaction Chamber to reduce NOx.
   l. The input thermocouple will monitor the pollution input temperature and in conjunction with the output thermocouple, adjust the fuel to keep the exhaust temperature constant.
   m. System is now full on with the controller making minor adjustments to keep the output temperature constant.

System Shut Down Sequence.
   a. Turn system switch to the off position.
   b. Fuel pump is turned off.
   c. Igniter is turned off
   d. Blower is left on until exhaust thermocouple reaches a preset temperature.

It is to be noted that the overall components, namely the elongated cylinder (16), the pollution delivery structure (14), the adapter (36 or 52), the baffle plates (34), and/or the urea delivery structure (84) are each made from (or laminated with) a high heat-resistant material of engineering choice, such as stainless steel, inconel, hasteloy, ceramic, etc., or any other material that can withstand heat between 1800 and 2500 degrees Fahrenheit.

Although the invention has been herein shown and described in what is conceived to be the most practical and preferred embodiment, it is recognized that departures may be made there from within the scope and spirit of the invention, which is not to be limited to the details disclosed herein but is to be accorded the full scope of the claims so as to embrace any and all equivalent devices and apparatuses.

Having described the invention, what I claim as new and desire to secure by Letters Patent is:

1. A three phased combustion system comprising: a fuel/air/igniter/blower injection apparatus; a pollution delivery structure; and an elongated cylinder; said elongated cylinder being internally partitioned by a first baffle plate, a second baffle plate and a third baffle plate, said elongated cylinder having a fuel/air inlet, said fuel/air inlet with said first baffle plate defining a first phase first phase mixing chamber there between, said first baffle plate with said second baffle plate defining a second phase combustion chamber there between, said second baffle plate with said third baffle plate defining a third phase reaction chamber there between, said third baffle plate providing an exit means for expelling resultant hot environmentally friendly air there from, said first phase first phase mixing chamber providing a first outer radius, said pollution delivery structure being of a length equal to said first phase mixing chamber, said pollution delivery structure providing a second outer radius that is larger than said first outer radius, thus said first phase mixing chamber is contained within said pollution delivery structure yet spaced apart forming a circulating pollution flow passage there between externally around said first phase mixing chamber, said pollution delivery structure having a pollution inlet duct for receiving forcibly directed pollution therein, said pollution inlet duct being in open communication with said pollution flow passage for delivering forcibly directed pollution thereto and said first phase mixing chamber having pollution inlet apertures there through for delivering said forcibly directed pollution into said first phase mixing chamber, whereby;

when the fuel/air mixture with said pollution is forcibly directed into said first phase mixing chamber and then ignited, said fuel/air mixture with said pollution in combination are chemically converted into a first phase gaseous substance, due to the construction of said first phase first phase mixing chamber with said fuel/air/igniter/blower injection apparatus and said first baffle plate in combination a first internal vortex consisting of said first phase gaseous substance is created within said first phase first phase mixing chamber, the result being increased dwell time wherein all particulate matter is forcibly concentrated toward and into the eye of said first internal vortex this simultaneously causing NOx within said first phase gaseous substance to be converted into a nitrogen/oxygen mixture, said first baffle plate having directional vanes for receiving and delivering said nitrogen/oxygen mixture into said second phase combustion chamber, whereby;

when said nitrogen/oxygen mixture is forcibly directed into said second phase combustion chamber, due to the construction of said first baffle plate with said second phase combustion chamber and said second baffle plate in combination, a second internal vortex consisting of predominantly nitrogen is created within said second phase combustion chamber, the result being increased dwell time of which in turn produces intense heat resulting in consumption of the majority of any remaining oxygen, thus resulting in an oxygen deprived nitrogen mixture resulting in almost total destruction of NOx because said oxygen deprived nitrogen mixture has minimal oxygen atoms to bond with, said second baffle plate having directional vanes for receiving and delivering said oxygen deprived nitrogen mixture into said third phase reaction chamber, whereby;

when said oxygen deprived nitrogen mixture is forcibly directed into said third phase reaction chamber, due to the construction of said second baffle plate with said third phase reaction chamber and said third baffle plate in combination, a third internal vortex is created within said third phase reaction chamber consisting of predominantly nitrogen, $CO_2$ and CO, this simultaneously resulting in a dramatic decrease of said intense heat resulting in a lower temperature wherein NOx cannot formulate, thus within said third phase reaction chamber the process is finalized and said resultant hot environmentally friendly air can be expelled there from via said exit means and said resultant hot environmentally friendly air is usable for energy purposes.

2. The three phased combustion system of claim 1 wherein said fuel/air/igniter/blower injection apparatus comprising: an adapter assembly having an enlarged first open end; an opposite smaller open end; an internal ignition zone; and igniter(s); said enlarged first open end being of a shape and size to mate with said fuel/air inlet of said elongated cylinder, said opposite smaller open end being attached onto a pipe fixture having a first extension and a second extension, said first extension being in open communication with a gaseous fuel delivery port, said second extension being in open communication with a fresh air delivery port, said gaseous fuel delivery port and said fresh air delivery port being in open communication via said pipe fixture resulting in production of said fuel/air mixture, said pipe fixture having an open exit port that is in alignment with said internal ignition zone for delivery of said fuel/air mixture from said open exit port into said internal ignition zone and said opposing pair of igniters being mounted onto said adapter assembly in open communication with said ignition zone for igniting said fuel/air mixture within said ignition zone.

3. The three phased combustion system of claim 2 wherein said fuel/air/igniter/blower injection apparatus is functional for any type of gaseous fuel such as either, propane, natural gas, methane or butane.

4. The three phased combustion system of claim 2 wherein said adapter assembly is of a shape having only smooth internal surfaces.

5. The three phased combustion system of claim 1 wherein said fuel/air/igniter/blower injection apparatus comprising: an adapter assembly having an enlarged first open end, an opposite smaller open end and an internal ignition zone, an elongated tubular member; and a fuel nozzle/igniter support structure; said enlarged first open end being of a shape and size to mate with said fuel/air inlet of said elongated cylinder, said elongated tubular member having a first end that is externally mounted onto said adapter assembly, said elongated tubular member having an enclosed second end, said elongated tubular member housing said fuel nozzle/igniter support structure therein, said fuel nozzle/igniter support structure having a first aperture, a second aperture and multiple air apertures there through, said first aperture being of a shape and size to receive and fixedly support a fuel nozzle therein, said second aperture being of a size to receive and fixedly support an igniter therein, said first aperture with said fuel nozzle being in open communication with said ignition zone, said second aperture with said igniter being in open communication with said ignition zone, said elongated tubular member having a fresh air inlet duct for receiving and delivering fresh air into said elongated tubular member via a blower, said multiple air apertures being in open communication with said ignition zone for delivering said fresh air into said ignition zone, said enclosed second end having a fuel line receptacle there through for support of a fuel line therein, said fuel line being interconnected onto said fuel nozzle for supplying fuel into said ignition zone via said fuel nozzle, said enclosed second end having an opening there through for containment of an electrical lead and said electrical lead being interconnected onto said igniter for energizing thereof.

6. The three phased combustion system of claim 5 wherein said fuel/air/igniter/blower injection apparatus is functional for any type of liquid fuel such as either diesel, gasoline, aviation fuel, oil, kerosene, vegetable oil or alcohol.

7. The three phased combustion system of claim 5 wherein said adapter assembly is of a shape having only smooth internal surfaces.

8. The three phased combustion system of claim 1 wherein said first phase mixing chamber having pollution inlet apertures there through for delivering said forcibly directed pollution into said first phased mixing chamber, said pollution inlet apertures are preferably angled at 45°, this further increases the spiraling motion within said first phase mixing chamber and increases the velocity and strength of said first internal vortex.

9. The three phased combustion system of claim 1 wherein said reaction chamber further includes inlet holes for receiving a urea substance there through via a urea delivery structure comprising: a canister having an internal radius that is larger than said first outer radius, said canister having a left side end and a right side end, each said side end being fixedly attached onto an external surface surrounding said reaction chamber with said inlet holes, said canister forming an internal air pocket surrounding said reaction chamber with said inlet holes, said air pocket being in open communication with said inlet holes, said canister being interconnected onto a urea substance delivery conduit, said urea substance delivery conduit being interconnected onto a urea injection nozzle for receiving said urea substance there through, said urea substance delivery conduit being in open communication with said air pocket and said inlet holes for supplying said urea substance to said reaction chamber.

10. The three phased combustion system of claim 9 further includes a micro-controller/computer that allows and provides adjustable/variable alternatives for control and programming of the entire system, said micro-controller/computer is interconnected in electrical communication with a fuel pump, a fuel tank, an air blower, an igniter(s), urea air blower, a pollution input thermocouple, a reaction chamber thermocouple, a urea metering pump, a urea tank, said fuel pump, said fuel tank and a fuel nozzle are interconnected with each other, said urea air blower, said urea substance delivery conduit, said urea injection nozzle, said urea metering pump and said urea tank are interconnected with each other.

11. The three phased combustion system of claim 9 further includes a fuel by-pass that is functional for returning any excess fuel back to said fuel tank for re-use for an economical advantage and said fuel by-pass is in electrical communication with said micro-controller/computer.

12. The three phased combustion system of claim 9 wherein said inlet holes are preferably angled at 45°, this further increases the spiraling motion within said reaction chamber and increases the velocity and strength of said third internal vortex.

13. The three phased combustion system of claim 1 wherein said elongated cylinder is made from or laminated with a high heat-resistant material capable of withstanding heat between 1800 to 2500 degrees Fahrenheit, including stainless steel, inconel, hasteloy or ceramic.

14. The three phased combustion system of claim 1 wherein each said baffle plate is made from a high heat-resistant material capable of withstanding heat between heat 1800 to 2500 degrees Fahrenheit, including stainless steel, inconel, hasteloy or ceramic.

15. The three phased combustion system of claim 1 wherein each said baffle plate is coated with a high heat-resistant material capable of withstanding heat between 1800 to 2500 degrees Fahrenheit, including stainless steel, inconel, hasteloy or ceramic.

* * * * *